US010273916B2

(12) United States Patent
Nozu et al.

(10) Patent No.: US 10,273,916 B2
(45) Date of Patent: Apr. 30, 2019

(54) INTERNAL COMBUSTION ENGINE

(71) Applicant: MITSUBISHI JIDOSHA KOGYO KABUSHIKI KAISHA, Tokyo (JP)

(72) Inventors: Kenichi Nozu, Tokyo (JP); Tadanori Minoura, Tokyo (JP); Takeshi Ohshima, Tokyo (JP); Genki Kurimoto, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 97 days.

(21) Appl. No.: 15/473,258

(22) Filed: Mar. 29, 2017

(65) Prior Publication Data

US 2017/0284353 A1 Oct. 5, 2017

(30) Foreign Application Priority Data

Mar. 30, 2016 (JP) ..... 2016-068903

(51) Int. Cl.
*F02M 37/00* (2006.01)
*F02M 39/02* (2006.01)
(Continued)

(52) U.S. Cl.
CPC ..... *F02M 37/0047* (2013.01); *F02F 1/24* (2013.01); *F02M 39/02* (2013.01); *F02M 53/00* (2013.01);
(Continued)

(58) Field of Classification Search
CPC .. F02M 21/0245; F02M 55/02; F02M 69/046; F02M 39/02; F02M 55/025
See application file for complete search history.

(56) References Cited

U.S. PATENT DOCUMENTS

2012/0279474 A1 11/2012 Hoefner et al.
2012/0312278 A1* 12/2012 Usui ..... F02M 59/462 123/446
2015/0167604 A1 6/2015 Hoefner et al.

FOREIGN PATENT DOCUMENTS

CN 102753813 A 10/2012
EP 2 541 039 A1 1/2013
(Continued)

OTHER PUBLICATIONS

Extended European Search Report dated Jun. 6, 2017 in corresponding European Patent Application No. 17163560.0.
(Continued)

*Primary Examiner* — Hung Q Nguyen
*Assistant Examiner* — Mark L. Greene
(74) *Attorney, Agent, or Firm* — Birch, Stewart, Kolasch & Birch, LLP

(57) ABSTRACT

An internal combustion engine including an intake passage fuel injection valve for injecting fuel into an intake passage and a cylinder inside fuel injection valve for injecting fuel into a combustion chamber, includes: a fuel pump pressurizing and feeding fuel, which is fed from a fuel tank, to the cylinder inside fuel injection valve; a securing part provided on a cylinder head member of the internal combustion engine to secure the fuel pump; an introducing member having heat conductivity, the introducing member connected to the fuel pump and formed with: a first introducing path for introducing fuel from the fuel tank to the fuel pump; and a second introducing path for introducing fuel from the fuel tank to the intake passage fuel injection valve; and a heat transmitting member transmitting heat between the introducing member and the securing part.

4 Claims, 4 Drawing Sheets

(51) Int. Cl.

| | |
|---|---|
| ***F02M 53/00*** | (2006.01) |
| ***F02M 55/00*** | (2006.01) |
| ***F02F 1/24*** | (2006.01) |
| ***F02M 59/48*** | (2006.01) |
| *F02M 69/04* | (2006.01) |

(52) U.S. Cl.

CPC ..... *F02M 55/005* (2013.01); *F02M 59/48* (2013.01); *F02M 69/046* (2013.01); *F02M 2200/803* (2013.01)

(56) References Cited

FOREIGN PATENT DOCUMENTS

| | | | |
|---|---|---|---|
| EP | 2 772 641 | A | 9/2014 |
| GB | 2 195 708 | A | 4/1988 |
| JP | 2007-16699 | A | 1/2007 |
| JP | 5730387 | B2 | 6/2015 |

OTHER PUBLICATIONS

Chinese Office Action and Search Report for corresponding Chinese Application No. 201710149523.6, dated Dec. 27, 2018, with English translation.

* cited by examiner

INTERNAL COMBUSTION ENGINE

CROSS-REFERENCE TO RELATED APPLICATION(S)

This application is based upon and claims the benefit of priority from prior Japanese patent application No. 2016-068903, filed on Mar. 30, 2016, the entire contents of which are incorporated herein by reference.

BACKGROUND

The present invention relates to an internal combustion engine.

There has been known a internal combustion engine which is provided with an cylinder inside fuel injection valve for injecting fuel into a combustion chamber, and an intake passage fuel injection valve for injecting the fuel into an intake passage, and controls fuel injection amounts at the respective fuel injection valves according to rotation speed, load, etc. of the internal combustion engine.

By feeding the fuel which is pressurized by a high pressure fuel pump to the cylinder inside fuel injection valve, it is possible to inject the fuel into the combustion chamber.

The high pressure fuel pump is fixed, for example, to a cylinder head of the internal combustion engine, and is operated with rotation of a cam shaft of the internal combustion engine.

Further, there is disclosed in Japanese Patent Publication No. 5730387, such a structure of a high pressure fuel pump, in which the fuel is pressurized as described above, that a part of the fuel which is fed from the fuel tank is allowed to pass through a housing of the high pressure fuel pump, without being pressurized to a high pressure, and can be fed to the intake passage fuel injection valve.

As the results, in Japanese Patent Publication No. 5730387, it is possible to cool the high pressure fuel pump with the fuel which is fed to the intake passage fuel injection valve, when the fuel is fed to the intake passage fuel injection valve only. Accordingly, when the internal combustion engine is operated by feeding the fuel to the intake passage fuel injection valve only, it is possible to restrain heat-up of the high pressure fuel pump due to the heat which is transmitted from the cylinder head of the internal combustion engine.

However, in the art disclosed in Japanese Patent Publication No. 5730387, the housing of the high pressure fuel pump must be provided with a fuel outlet and so on for feeding a low pressure fuel. Therefore, as compared with a high pressure fuel pump which is employed in such an internal combustion engine that the intake passage fuel injection valve is not provided and feeds the high pressure fuel only, it is necessary to impart a different structure to a body part of the housing or so, which will make common use of components difficult.

SUMMARY

An object of the invention is to provide an internal combustion engine which is provided with a cylinder inside fuel injection valve, an intake passage fuel injection valve, and a fuel pump for feeding a pressurized fuel to the cylinder inside fuel injection valve, enabling the fuel pump to be cooled with the fuel which is fed to the intake passage fuel injection valve, employing a simple structure.

In order to achieve the object, according to an aspect of the invention, there is provided an internal combustion engine which includes: an intake passage fuel injection valve for injecting fuel into an intake passage; and a cylinder inside fuel injection valve for injecting fuel into a combustion chamber, the internal combustion engine comprising: a fuel pump which is configured to pressurize and feed fuel, which is fed from a fuel tank, to the cylinder inside fuel injection valve; a securing part which is provided on a cylinder head member of the internal combustion engine to secure the fuel pump; an introducing member having heat conductivity, the introducing member which is connected to the fuel pump, and which is formed with: a first introducing path for introducing fuel from the fuel tank to the fuel pump; and a second introducing path for introducing fuel from the fuel tank to the intake passage fuel injection valve; and a heat transmitting member which is configured to transmit heat between the introducing member and the securing part.

DETAILED DESCRIPTION OF EXEMPLARY EMBODIMENTS

Figure 1:
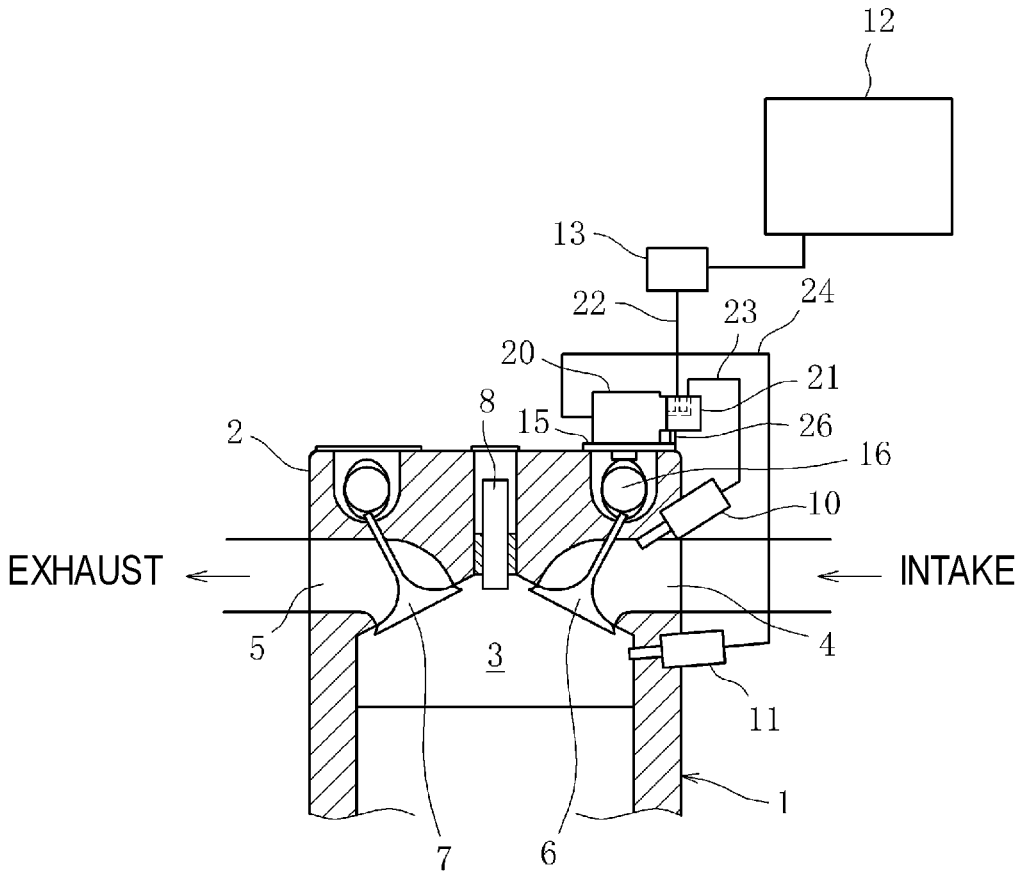
FIG. 1 is a schematic structural view of an engine in an embodiment according to the invention.

Now, an embodiment according to the invention will be described referring to the drawings.

FIG. 1 is a schematic structural view of an engine 1 (an internal combustion engine) in an embodiment according to the invention. It is to be noted that a single cylinder out of a multiple cylinder engine is shown in section, in FIG. 1.

The engine 1 in the embodiment according to the invention is, for example, an engine for driving an automobile. As shown in FIG. 1, an intake port 4 (an intake passage) and an exhaust port 5 communicating with a combustion chamber 3 are provided on a cylinder head 2 (a cylinder head member), and further, there are provided an intake valve 6 for opening or closing an opening between the intake port 4 and the combustion chamber 3, an exhaust valve 7 for opening or closing an opening between the exhaust port 5 and the combustion chamber 3, and an ignition plug 8 which is provided with an electrode on a face opposed to the combustion chamber 3.

Further, the cylinder head 2 of the engine 1 in this embodiment is provided with an intake passage fuel injection valve 10 for injecting fuel into the intake port 4, a cylinder inside fuel injection valve 11 for injecting the fuel into the combustion chamber 3, and a high pressure fuel pump 20 (a fuel pump) for pressurizing the fuel.

The intake passage fuel injection valve 10 having its injection nozzle disposed in the intake port 4 injects a low pressure fuel which is fed from a fuel tank 12 by a feed pump 13, into the intake port 4. It is to be noted that this fuel injection by way of the intake passage fuel injection valve 10 is called as intake passage fuel injection (MPI).

The cylinder inside fuel injection valve 11 having its injection nozzle disposed in the combustion chamber 3, injects a high pressure fuel which is fed from the high pressure fuel pump 20, into the combustion chamber 3. The high pressure fuel pump 20 pressurizes the low pressure fuel which is fed from the fuel tank 12 via the feed pump 13, and feeds the pressurized fuel to the cylinder inside fuel injection valve 11. It is to be noted that this fuel injection by way of the cylinder inside fuel injection valve 11 is called as cylinder inside fuel injection (DI).

The high pressure fuel pump 20 is fixed to a base 15 (a securing part) which is provided on an upper part or a side face of the cylinder head 2 with bolts or the like. Moreover, a feed pipe 21 (an introducing member) in a shape of a block is fixed to a side face of the high pressure fuel pump 20.

A fuel feeding pipe 22 (a fuel feeding passage) to which the fuel is fed from the fuel tank 12 via the feed pump 13, and a low pressure fuel pipe 23 for feeding the fuel to the intake passage fuel injection valve 10 are connected to the feed pipe 21. Moreover, a high pressure fuel pipe 24 which is connected to the cylinder inside fuel injection valve 11 is connected to the side face of the high pressure fuel pump 20.

The fuel which is fed from the fuel feeding pipe 22 into the feed pipe 21 is fed to an inside of the high pressure fuel pump 20. The high pressure fuel pump 20 is operated by a cam which is provided on an intake cam shaft 16 for actuating the intake valve 6. By operating the high pressure fuel pump 20, the fuel which is fed via the fuel feeding pipe 22 and the feed pipe 21 is pressurized, and the pressurized fuel is fed to the cylinder inside fuel injection valve 11 via the high pressure fuel pipe 24.

Moreover, the fuel which is fed from the fuel feeding pipe 22 into the feed pipe 21 is branched inside the feed pipe 21, and fed to the intake passage fuel injection valve 10 via the low pressure fuel pipe 23, irrespective of the operation of the high pressure fuel pump 20.

It is to be noted that switching between an MPI mode and a DI mode is conducted by an engine control unit, which is not shown, for controlling the intake passage fuel injection valve 10 and the cylinder inside fuel injection valve 11. For example, the DI mode is selected in a high load zone, while the MPI mode is selected in a low load zone.

Figure 2:
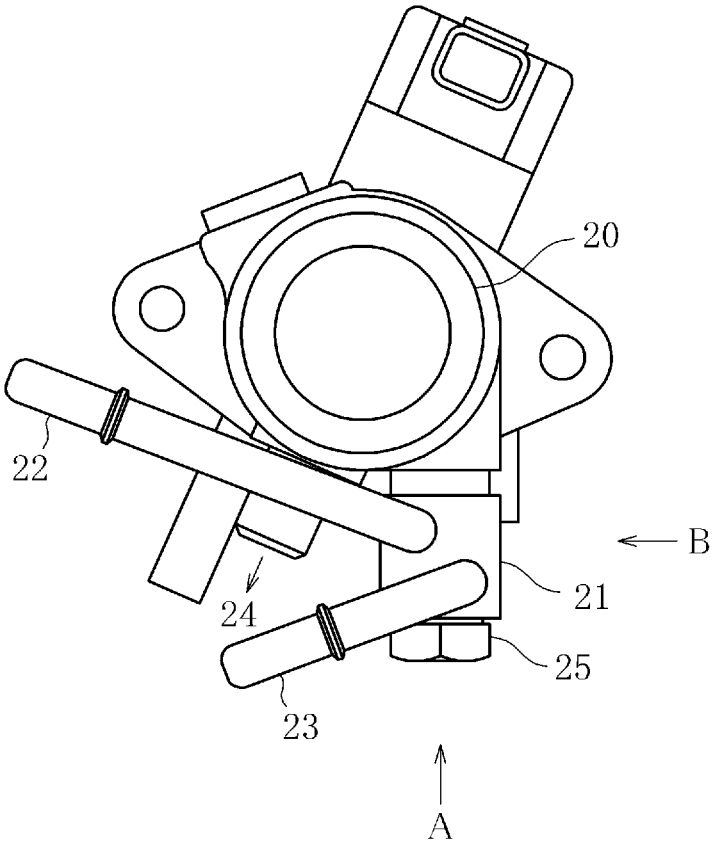
FIG. 2 is a plan view showing a mounting structure of a high pressure fuel pump in the embodiment.
Figure 3:
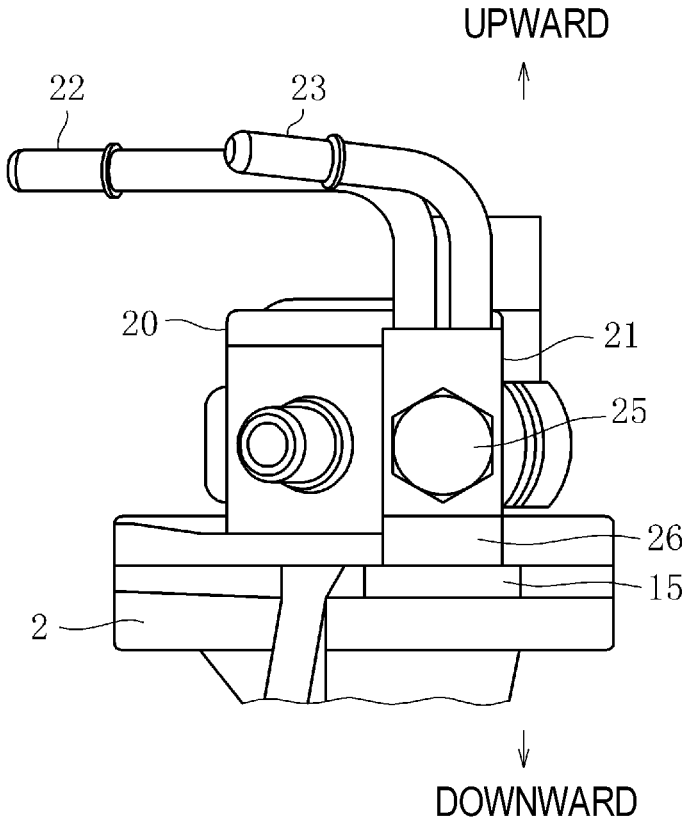
FIG. 3 is a side elevation view showing the mounting structure of the high pressure fuel pump in the embodiment.
Figure 4:
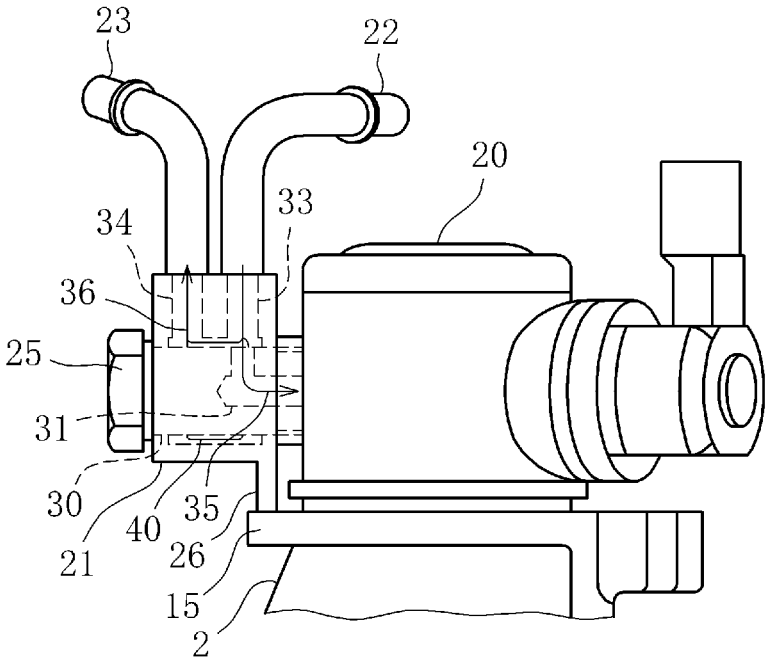
FIG. 4 is another side elevation view showing the mounting structure of the high pressure fuel pump in the embodiment.

FIG. 2 is a plan view showing a mounting structure of the high pressure fuel pump 20 in this embodiment. FIG. 3 is a side elevation view showing the mounting structure of the high pressure fuel pump 20 in this embodiment. FIG. 4 is another side elevation view showing the mounting structure of the high pressure fuel pump 20 in this embodiment. It is to be noted that FIG. 3 is the side elevation view as seen in a direction of an arrow mark A in FIG. 2, and FIG. 4 is the side elevation view as seen in a direction of an arrow mark B in FIG. 2.

As shown in FIGS. 2 to 4, the feed pipe 21 is fastened to the side face of the high pressure pump 20 with a piece of bolt 25.

The fuel feeding pipe 22 and the low pressure fuel pipe 23 are connected to the feed pipe 21. The feed pipe 21 is formed of material having high heat conductivity such as aluminum. A lower face of the feed pipe 21 is positioned at an upper level than the base 15 which is positioned below the high pressure fuel pump 20.

Inside the feed pipe 21, a gap 40 (a passage) is provided between an outer peripheral face of a shaft portion 30 of the bolt 25 and an inner peripheral face of the feed pipe 21.

The shaft portion 30 of the bolt 25 is formed with a bolt inside communicating path 31 which is extended along a center line and opened at a distal end side. The bolt inside communicating path 31 has an opening on the outer peripheral face of the shaft portion 30 at a side opposed to the gap 40.

Moreover, there are formed, inside the feed pipe 21, a fuel feed communicating path 33 which interconnects the opening of the bolt inside communicating path 31 and the fuel feeding pipe 22, and a low pressure fuel feed communicating path 34 which interconnects the fuel feed communicating path 33 and the low pressure fuel pipe 23 via the gap 40.

Further, inside the feed pipe 21 which is fastened by means of the bolt 25, the fuel feed communicating path 33 and the bolt inside communicating path 31 cooperate to form a first introducing path 35 which introduces the fuel from the fuel feeding pipe 22 to the high pressure fuel pump 20. At the same time, the fuel feed communicating path 33, the gap 40, and the low pressure fuel feed communicating path 34 cooperate to form a second introducing path 36.

Furthermore, in this embodiment, apart of the lower face of the feed pipe 21 is projected downward thereby to form a projected part 26 (a heat transmitting member) in a polyhedral shape. A lower face of the projected part 26 is in face contact with a face portion which is provided on the base 15.

According to the above described structure, in the present embodiment, it is possible to cool the high pressure fuel pump 20 with the fuel having relatively low temperature which flows from the fuel feeding pipe 22 to the feed pipe 21.

By the way, the high pressure fuel pump 20 is fixed to the base 15 which is provided on the cylinder head 2 of the engine 1, and therefore, the heat of the engine 1 is transmitted to the high pressure fuel pump 20 by way of the base 15.

While the engine 1 is operated in the MPI mode only, out of the MPI mode and the DI mode, for example, on occasion of the operation of the engine 1 in the low load zone, the fuel stays inside the high pressure fuel pump 20. Therefore, when the engine 1 is operated in the MPI mode only, the heat of the engine 1 is transmitted to the high pressure fuel pump 20, and it is concerned that the fuel staying inside the high pressure fuel pump 20 may be heated.

On the other hand, in this embodiment, it is so constructed that the fuel passes through the feed pipe 21 having the high heat conductivity which is fixed to the high pressure fuel pump 20, and then, the fuel is fed to the intake passage fuel injection valve 10. Therefore, even in case where the engine 1 is operated in the MPI mode only, it is possible to cool the high pressure fuel pump 20 by way of the feed pipe 21.

Further, in this embodiment, a part of the lower face of the feed pipe 21 is extended downward to form the projected part 26, and this projected part 26 is in contact with the base 15. Therefore, heat transmission occurs between the feed pipe 21 and the base 15 by way of the projected part 26. Accordingly, the base 15 can be cooled with the fuel which passes through the feed pipe 21, by way of the feed pipe 21 and the projected part 26. Because the base 15 is interposed between the cylinder head 2 of the engine 1 and the high pressure fuel pump 20, it is possible to effectively reduce the heat which is transmitted from the cylinder head 2 to the high pressure fuel pump 20, by cooling the base 15.

In this manner, when the engine 1 is operated in the MPI mode only, heating of the high pressure fuel pump 20 can be depressed, and deterioration of the high pressure fuel pump 20 can be restrained. At the same time, heating of the fuel which stays inside the high pressure fuel pump 20 is depressed, and occurrence of vapor from the fuel staying inside the high pressure fuel pump 20 is restrained. As the results, it is possible to prevent faulty operation of the high pressure fuel pump 20 and the engine 1.

Moreover, the fuel feed communicating path 33 and the low pressure fuel feed communicating path 34 are communicated in the outer peripheral part of the shaft portion 30 of the bolt 25 inside the feed pipe 21, and there is provided the gap 40 for passing the fuel which is introduced form the first introducing path 35 to the second introducing path 36. Therefore, it is possible to effectively cool the feed pipe 21 with the fuel which passes through the gap 40. Particularly, it is possible to effectively cool the projected part 26 with the fuel which passes through the gap 40 at a position near the projected part 26.

Further, the feed pipe 21 is fixed to the side face of the high pressure fuel pump 20 by means of the single bolt 25, and therefore, the feed pipe 21 is fixed so as to rotate around an axis of the bolt 25 with respect to the high pressure fuel pump 20. However, because the projected part 26 of the feed pipe 21 is in face contact with the base 15, this projected part 26 has a function of restricting the rotation of the feed pipe 21.

As described above, in this embodiment, with such a simple structure that a part of the feed pipe 21 is extended and contacted with the base 15, it is possible to obtain both functions of preventing the rotation of the feed pipe 21 and cooling the high pressure fuel pump 20.

Moreover, by exchanging the feed pipe 21 with a feed pipe to which the low pressure fuel pipe 23 is not connected, it is possible to use the high pressure fuel pump 20 for an engine which is exclusively used in the DI mode only and not provided with the intake passage fuel injection valve 10. Therefore, the high pressure fuel pump 20 can be commonly used as the high pressure fuel pump to be used for the engine for the DI mode only. In this manner, reduction of the cost for the high pressure fuel pump 20 can be achieved.

It is to be noted that the present invention is not limited to the above described embodiment. For example, in this embodiment, the projected part 26 is formed by extending apart of the lower face of the feed pipe 21 downward. However, it is also possible to provide a heat transmitting member which connects the feed pipe 21 to the base 15, as a separate member from the feed pipe 21. Alternatively, such a structure that a part of the feed pipe 21 is directly contacted with the base 15 may be adopted.

Moreover, the gap 40 for communicating the fuel feed communicating path 33 and the low pressure fuel feed communicating path 34 may be provided only in a lower part of the bolt 25 so that the fuel may pass at the possible closest position to the projected part 26. In this manner, it is possible to more effectively cool the projected part 26 with the fuel passing through the gap 40.

Moreover, the invention can be also applied to such an engine that the high pressure fuel pump 20 is fixed to a member which is provided on the cylinder head 2, such as a cylinder head cover (a cylinder head member). In this case too, it is possible to depress the heat which is transmitted to the high pressure fuel pump 20 from the cylinder head member such as the cylinder head cover.

Moreover, although the projected part 26 is used as a rotation detent for the feed pipe 21 in the above described embodiment, a bracket or the like which is supported by the high pressure fuel pump 20, for example, may be provided as the rotation detent for the feed pipe 21, separately from the projected part 26.

According to the internal combustion engine of the present invention, there is provided the heat transmitting member for transmitting the heat between the introducing member and the securing part of the internal combustion engine for securing the high pressure fuel pump, and the introducing member is provided with the second introducing path for introducing the fuel from the fuel tank to the intake passage fuel injection valve. Therefore, it is possible to cool the securing part which is provided on the cylinder head, with the fuel passing through the second introducing path, while the fuel is introduced to the intake passage fuel injection valve by way of the second introducing path.

As the results, it is possible to cool the high pressure fuel pump, on occasion where the internal combustion engine is operated with the fuel injection by the intake passage fuel injection valve. Particularly, by cooling the securing part, the heat which is transmitted from the internal combustion engine to the fuel pump by way of the securing part can be effectively depressed.

Moreover, the heat which is transmitted from the internal combustion engine to the fuel pump by way of the introducing member and the heat transmitting member can be depressed, and therefore, it is possible to restrain heat up of the fuel pump, employing the simple structure.

What is claimed is:

1. An internal combustion engine which includes: an intake passage fuel injection valve for injecting fuel into an intake passage; and a cylinder inside fuel injection valve for injecting the fuel into a combustion chamber, the internal combustion engine comprising:

a fuel pump which is configured to pressurize and feed the fuel, which is fed from a fuel tank, to the cylinder inside fuel injection valve;

a securing part which is provided on a cylinder head member of the internal combustion engine to secure the fuel pump;

an introducing member having heat conductivity, the introducing member being connected to the fuel pump, and being formed with: a first introducing path for introducing the fuel from the fuel tank to the fuel pump; and a second introducing path for introducing the fuel from the fuel tank to the intake passage fuel injection valve; and a heat transmitting member which is configured to transmit heat between the introducing member and the securing part, wherein the introducing member is a polyhedral body having heat conductivity which is fixed to the fuel pump with a bolt, at least one face of the polyhedral body is in face contact with a face portion of the securing part, and a passage for passing the fuel which is introduced from the first introducing path to the second introducing path is provided in an outer peripheral part of the bolt.

2. The internal combustion engine according to claim 1, wherein the introducing member is connected to the fuel pump, and the heat transmitting member is in contact with the securing part to restrict rotation of the introducing member with respect to the fuel pump.

3. The internal combustion engine according to claim 1, wherein the heat transmitting member is formed by extending a part of the introducing member toward the face portion, and is in face contact with the face portion.

4. An internal combustion engine which includes: an intake passage fuel injection valve for injecting fuel into an intake passage; and a cylinder inside fuel injection valve for injecting the fuel into a combustion chamber, the internal combustion engine comprising:

a fuel pump which is configured to pressurize and feed the fuel, which is fed from a fuel tank, to the cylinder inside fuel injection valve;

a securing part which is provided on a cylinder head member of the internal combustion engine to secure the fuel pump;

an introducing member having heat conductivity, the introducing member being connected to the fuel pump, and being formed with: a first introducing path for introducing the fuel from the fuel tank to the fuel pump; and a second introducing path for introducing the fuel from the fuel tank to the intake passage fuel injection valve; and a heat transmitting member which is configured to transmit heat between the introducing member and the securing part, wherein the introducing member is a polyhedral body having heat conductivity which is fixed to the fuel pump with a bolt, at least one face of the polyhedral body is in face contact with a face portion of the securing part, and a fuel feeding passage from the fuel tank is branched inside the introducing member thereby to form the first introducing path and the second introducing path, and a passage for passing the fuel which is fed from the first introducing path to the fuel pump is provided inside the bolt.

* * * * *